US008441427B2

(12) United States Patent
Wang

(10) Patent No.: US 8,441,427 B2
(45) Date of Patent: May 14, 2013

(54) GATE DRIVER HAVING AN OUTPUT ENABLE CONTROL CIRCUIT

(75) Inventor: Chun-Chieh Wang, Chiayi County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 500 days.

(21) Appl. No.: 12/538,177

(22) Filed: Aug. 10, 2009

(65) Prior Publication Data

US 2010/0303195 A1 Dec. 2, 2010

(30) Foreign Application Priority Data

May 26, 2009 (TW) ..... 98117485 A

(51) Int. Cl.
*G09G 3/36* (2006.01)

(52) U.S. Cl.
USPC ..... 345/99

(58) Field of Classification Search ..... 345/99
See application file for complete search history.

(56) References Cited

U.S. PATENT DOCUMENTS

| | | | | |
|---|---|---|---|---|
| 5,731,798 | A * | 3/1998 | Shin | 345/99 |
| 6,115,020 | A * | 9/2000 | Taguchi et al. | 345/99 |
| 6,335,715 | B1 * | 1/2002 | Lee | 345/87 |
| 6,362,805 | B1 * | 3/2002 | Jeong | 345/99 |
| 6,407,729 | B1 * | 6/2002 | Moon | 345/99 |
| 6,445,372 | B1 * | 9/2002 | Asai | 345/99 |
| 2001/0013849 | A1 * | 8/2001 | Furukoshi | 345/87 |
| 2001/0043201 | A1 * | 11/2001 | Taguchi et al. | 345/204 |
| 2003/0151585 | A1 * | 8/2003 | Ito et al. | 345/100 |
| 2004/0041774 | A1 * | 3/2004 | Moon | 345/99 |
| 2005/0035958 | A1 * | 2/2005 | Moon | 345/204 |
| 2005/0057480 | A1 * | 3/2005 | Liao et al. | 345/98 |
| 2005/0253794 | A1 | 11/2005 | Lee | |
| 2006/0103619 | A1 * | 5/2006 | Kim | 345/98 |
| 2007/0159441 | A1 * | 7/2007 | Yang et al. | 345/99 |
| 2008/0030490 | A1 * | 2/2008 | Son et al. | 345/205 |
| 2008/0030615 | A1 | 2/2008 | Vasquez | |
| 2008/0218502 | A1 * | 9/2008 | Lee et al. | 345/208 |
| 2009/0021502 | A1 * | 1/2009 | Lee et al. | 345/205 |
| 2009/0219242 | A1 * | 9/2009 | Fuchigami et al. | 345/100 |
| 2009/0225104 | A1 * | 9/2009 | Hu et al. | 345/690 |
| 2010/0066708 | A1 * | 3/2010 | Kim et al. | 345/204 |

FOREIGN PATENT DOCUMENTS

| | | |
|---|---|---|
| TW | 444184 B | 7/2001 |
| TW | 460726 B | 10/2001 |
| TW | 200832316 | 8/2008 |
| TW | 200915289 | 4/2009 |
| TW | 200919413 | 5/2009 |

* cited by examiner

*Primary Examiner* — Chanh Nguyen
*Assistant Examiner* — Robert Stone
(74) *Attorney, Agent, or Firm* — Winston Hsu; Scott Margo

(57) ABSTRACT

A gate driver includes a shift register, a logic control circuit, and an output enable control circuit. The shift register generates a plurality of scan signals according to a vertical synchronous signal and a vertical clock signal. The output enable control circuit generates a second output enable signal according to the vertical synchronous signal, the vertical clock signal, and an output enable signal. After the vertical synchronous signal and the vertical clock signal are both triggered together for two times, the second output enable converts from a high level to a low level. The logic control circuit outputs the plurality of scan signals when the second output enable signal is at the low level.

7 Claims, 10 Drawing Sheets

GATE DRIVER HAVING AN OUTPUT ENABLE CONTROL CIRCUIT

BACKGROUND OF THE INVENTION

1. Field of the Invention

The present invention is related to a gate driver, and more particularly, to a gate driver with an output enable control circuit.

2. Description of the Prior Art

Please refer to FIG. 1. FIG. 1 is a diagram illustrating the gate driver 10 of a conventional Liquid Crystal Display (LCD) device. The gate driver includes a shift register 101, a logic control circuit 102, and an output driving circuit 103. The shift register 101 generates the scan signals X1~Xm according to the vertical synchronous signal STV and the vertical clock signal CPV, and transmits the vertical synchronous signal STV to a next gate driver 10. The logic control circuit 102 is electrically connected to the shift register 101 and the logic control circuit 102 outputs the scan signals X1~Xm according to the output enable signal OE. The output driving circuit 103 is electrically connected to the logic control circuit 102. The output driving circuit 103 converts the voltage level of the scan signals X1~Xm for generating the gate signals G1~Gm according to the gate high voltage VGH and the gate low voltage level VGL. The vertical synchronous signal STV, the vertical clock signal CPV and the output enable signal OE are provide by a timing controller 12.

Please refer to FIG. 2. FIG. 2 is a waveform diagram illustrating the signals provided by the timing controller 12. The gate driver 10 generates the gate signals G1~Gm according to the vertical synchronous signal STV, the vertical clock signal CPV and the output enable signal OE provided from the timing controller 12. When the output enable signal OE is at a low voltage level, the logic control circuit 102 outputs the scan signals X1~Xm and when the output enable signal OE is at a high voltage level, the logic control circuit 102 stops outputting the scan signals X1~Xm. Generally the logic control circuit 102 utilizes the output enable signal OE to block the scan signals X1~Xm being outputted within the period of the first frame. Meanwhile, the logic control circuit 102 performs, in coordination with the vertical synchronous signal STV and the vertical clock signal CPV (i.e. this is when the vertical synchronous signal STV and the vertical clock signal CPV are both at a high voltage level at the same time), a logic reset to the gate driver 10 for preventing the occurrence of excessive current in which the gate driver 10 is likely to be damaged. During the logic reset, it is necessary for the output enable signal OE to be maintained at a high voltage level until the vertical synchronous signal STV and the vertical clock signal CPV are both triggered (i.e. at a high voltage level) together for two times.

Please refer to FIG. 3. FIG. 3 is a waveform diagram illustrating the delay of the vertical clock signal CPV. When the output of the vertical clock signal CPV is delayed, the logic reset of the gate driver 10 is unable to be completed within the period of the first frame. However, in the subsequent frame (i.e. the second frame) the enable signal OE is converted from the high voltage level to the low voltage level, for outputting the scan signals X1~Xm. Therefore, the logic reset of the gate driver 10 is incomplete and consequently excessive current may be generated and the gate driver 10 is likely to be damaged.

Please refer to FIG. 4. FIG. 4 is a waveform diagram illustrating the delay of the output enable signal OE. Since the output of the scan signals X1~Xm is blocked only when the output enable signal OE is at a high voltage level, so when the output of the output enable signal OE is delayed, the gate driver 10 is likely to output the scan signals X1~Xm in the period of the first frame. However, the logic reset of the gate driver 10 is performed in the period of the first frame and if the scan signals X1~Xm are outputted concurrently when the logic reset is incomplete, excessive current may be generated and consequently the gate driver 10 is likely to be damaged.

Therefore, the logic reset of the gate driver 10 is performed prior the gate driver 10 generates the gate signals G1~Gm; in other words, the vertical synchronous signal STV and the vertical clock signal CPV are both triggered together for two times (i.e. at a high voltage level) and the output enable signal OE is at a high voltage level within the period between the first time and the second time the vertical synchronous signal STV and the vertical clock signal CPV are both triggered, for blocking the scan signals X1~Xm from being outputted. The delay of the output of the vertical synchronous signal STV or the output enable signal OE causes incomplete logic reset of the gate driver 10. When the logic reset of the gate driver 10 is incomplete, excessive current may be generated and consequently the gate driver 10 is likely to be damaged.

SUMMARY OF THE INVENTION

The present invention provides a gate driver. The gate driver comprises a shift register, an output enable control circuit, and a logic control circuit. The shift register is used for generating a plurality of scan signals according to a vertical synchronous signal and a vertical clock signal. The output enable control circuit is used for generating a second output enable signal according to the vertical synchronous signal, the vertical clock signal and an output enable signal. When the vertical synchronous signal and the vertical clock signal are both triggered together for two times, the second output enable signal converts from the high voltage level to a low voltage level. The logic control circuit is electrically connected to the shift register and the output enable control circuit, for outputting the plurality of the scan signals when the second output enable signal is at the low voltage level.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function In the following description and in the claims, the terms "include" and "comprise" are used in an open-ended fashion, and thus should be interpreted to mean "include, but not limited to . . . " Also, the term "electrically connect" is intended to mean either an indirect or direct electrical connection. Accordingly, if one device is coupled to another device, that connection may be through a direct electrical connection, or through an indirect electrical connection via other devices and connections.

Figure 1:
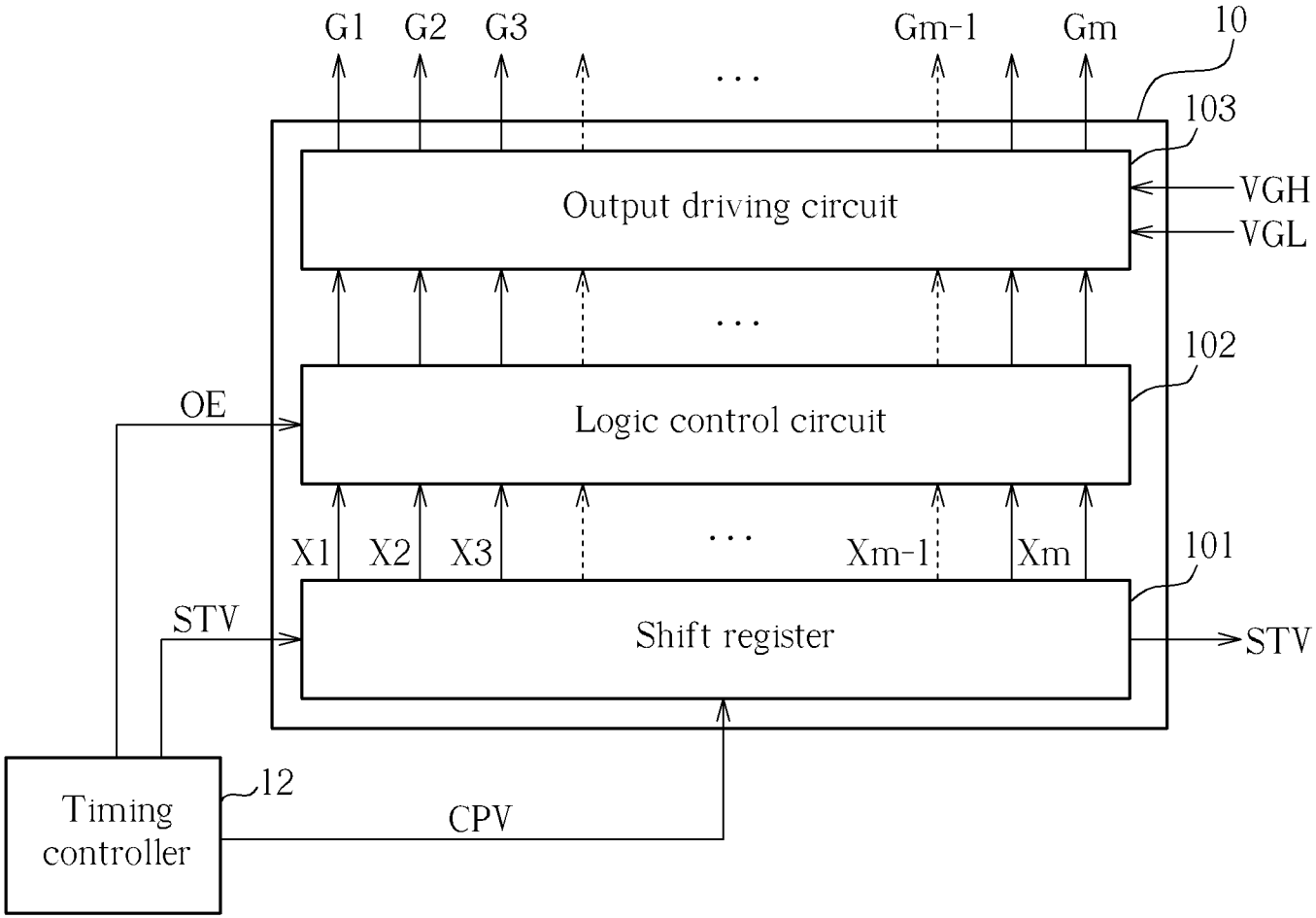
FIG. 1 PRIOR ART
FIG. 1 is a diagram illustrating the gate driver of a conventional Liquid Crystal Display (LCD) device.
Figure 2:
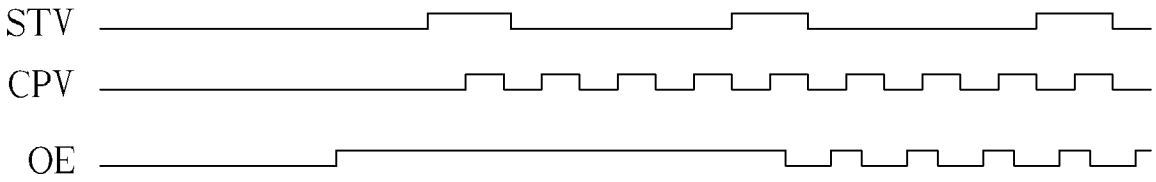
FIG. 2 PRIOR ART
FIG. 2 is a waveform diagram illustrating the signals provided by the timing controller.
Figure 3:
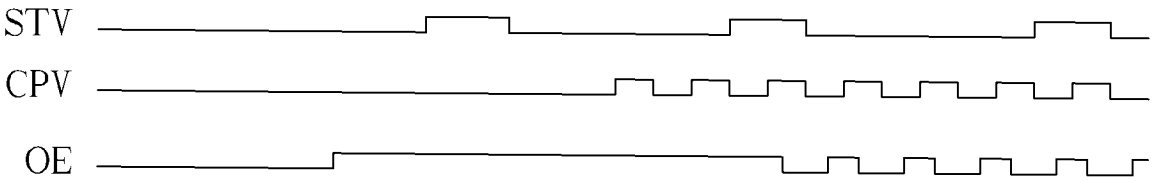
FIG. 3 PRIOR ART
FIG. 3 is a waveform diagram illustrating the delay of the vertical clock signal.
Figure 4:
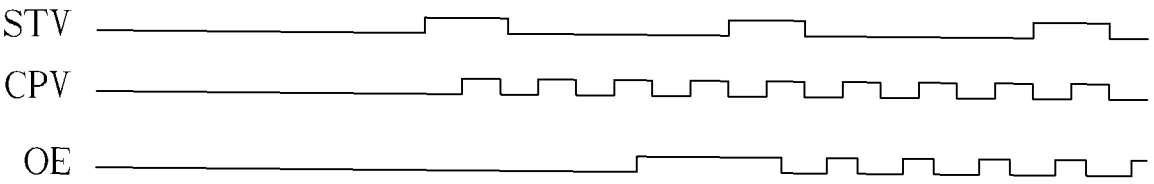
FIG. 4 PRIOR ART
FIG. 4 is a waveform diagram illustrating the delay of the output enable signal.
Figure 5:
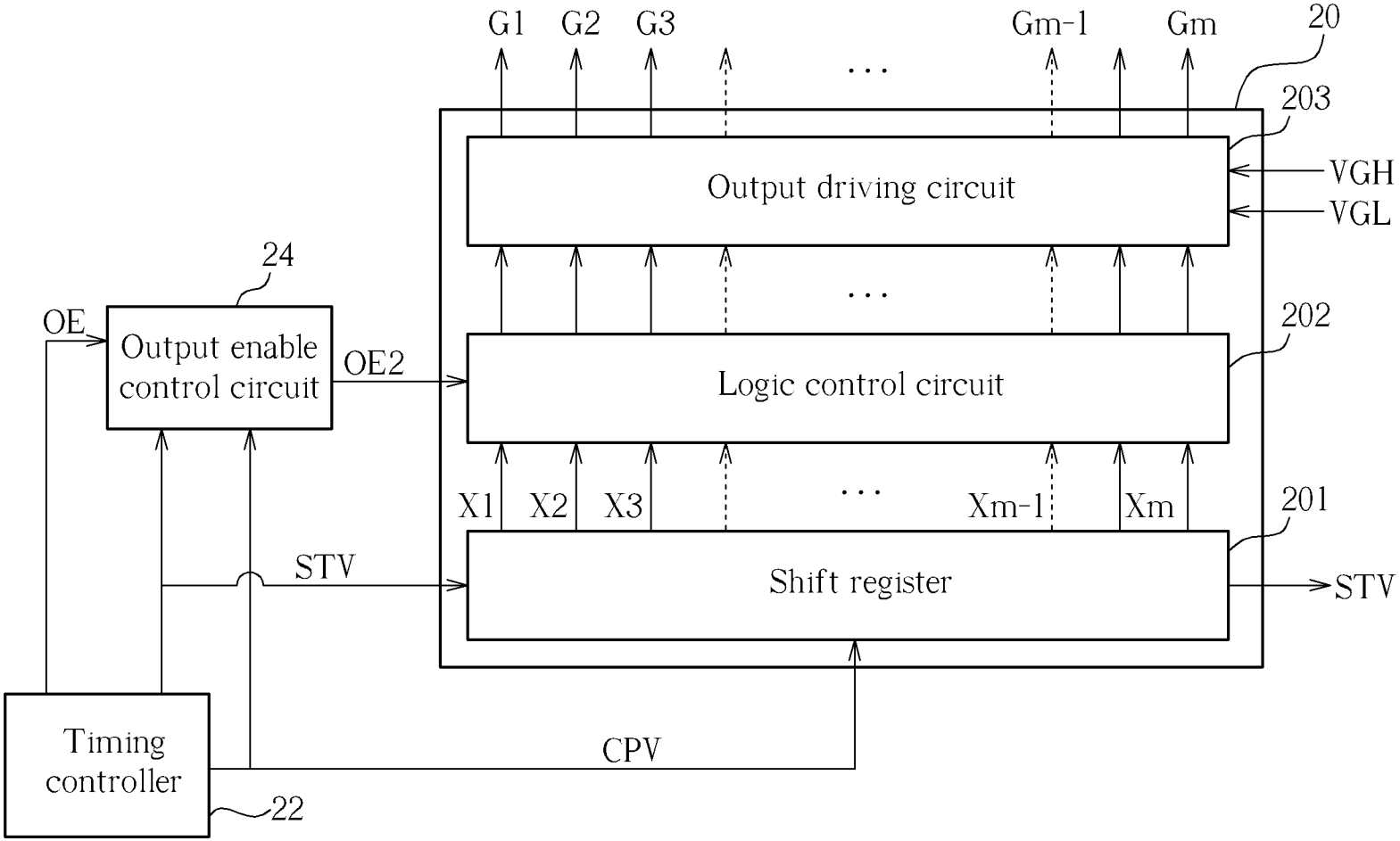
FIG. 5 is a diagram illustrating the gate driver of the Liquid Crystal Display (LCD) device of the present invention.

Please refer to FIG. 5. FIG. 5 is a diagram illustrating the gate driver 20 of the Liquid Crystal Display (LCD) device of the present invention. The gate driver 20 generates the gate signals G1~Gm according to the vertical synchronous signal STV, the vertical clock signal CPV and the output enable signal OE provided by the timing controller 22. The gate driver 20 comprises a shift register 201, a logic control circuit 202, an output driving circuit 203 and an output enable control circuit 24. The shift register 201 generates the scan signals X1~Xm according to the vertical synchronous signal STV and the vertical clock signal CPV, and transmits the vertical synchronous signal STV to the next gate driver 20. The output enable control circuit 24 generates a second output enable signal OE2 according to the vertical synchronous signal STV, the vertical clock signal CPV and the output enable signal OE, for preventing the occurrence of excessive current (i.e. excessive current may damage the gate driver 20) caused by the delayed output of the vertical clock signal CPV and the output enable signal OE. The logic control circuit 202 is electrically connected to the shift register 201 and the output enable control circuit 24. The logic control circuit 202 outputs the scan signals X1~Xm according to the second output enable signal OE2. The output driving circuit 203 is electrically connected to the logic control circuit 202. The output driving circuit 203 converts the voltage level of the scan signals X1~Xm for generating the gate signals G1~Gm, according to the gate high voltage level VGH and the gate low voltage level VGL.

Figure 6:
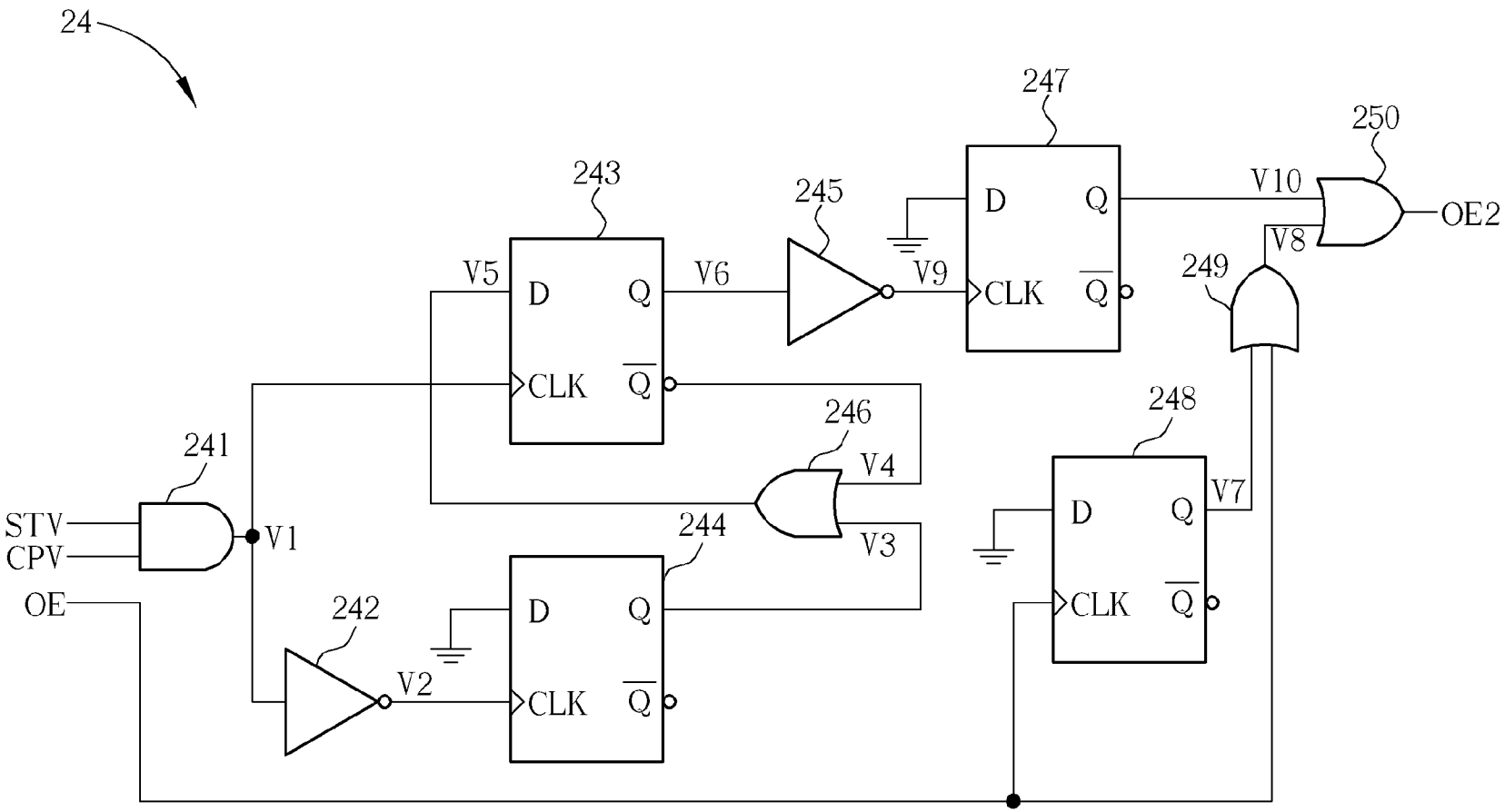
FIG. 6 is a diagram illustrating the output enable control circuit according to the present invention.

Please refer to FIG. 6. FIG. 6 is a diagram illustrating the output enable control circuit 24 according to the present invention. The output enable control circuit 24 comprises a first AND gate 241, a first inverter 242, a first flip-flop 243, a second flip-flop 244, a second inverter 245, a first OR gate 246, a third flip-flop 247, a fourth flip-flop 248, a second OR gate 249 and a third OR gate 250. The first AND gate 241 comprises two input ends, for receiving the vertical synchronous signal STV and the vertical clock signal CPV respectively; the output end of the first AND gate 241 is electrically connected to the clock input end of the first flip-flop 243 and the output end of the first AND gate 241 is also electrically connected to the clock input end of the second flip-flop 244 via the first inverter 242. The first OR gate 246 comprises two input ends electrically connected to the negative output end of the first flip-flop 243 and the positive output end of the second flip-flop 244 respectively; the output end of the first OR gate 246 is electrically connected to the data input end of the first flip-flop 243. The positive output end of the first flip-flop 243 is electrically connected to the clock input end of the third flip-flop 247 via the second inverter 245. The data input ends of the second flip-flop 244, the third flip-flop 247 and the fourth flip-flop 248 are all electrically connected to a ground end. The output enable signal OE is inputted to the clock input end of the fourth flip-flop 248 and an input end of the second OR gate 249 at the same time; the other input end of the second OR gate 249 is electrically connected to the positive output end of the fourth flip-flop 248. The third OR gate 250 comprises two input ends, electrically connected to the positive output end of the third flip-flop 247 and the output end of the second OR gate 249 respectively; the output end of the third OR gate 250 is utilized to output the second output enable signal OE2.

The first AND gate 241, the first flip-flop 243, the second flip-flop 244, the first OR gate 246 and the third flip-flop 247 are utilized to monitor if the vertical synchronous signal STV and the vertical clock signal CPV have been triggered together for two times. The fourth flip-flop 248 is utilized to monitor the input state of the output enable signal OE (i.e. if the output enable signal OE has been inputted). When the vertical synchronous signal STV and the vertical clock signal CPV have been triggered together for two times, if the input of the output enable signal OE is delayed (i.e. the output enable signal OE is at a low voltage level), the second output enable signal OE2 is maintained at a high voltage level. The voltage level of the nodes V8 and V10 control the output of the second output enable signal OE2. When the output enable signal OE is converted from a low voltage level to a high voltage level, the node V7 is locked at a low voltage level; similarly, when the node V2 is converted from a low voltage level to a high voltage level, the node V3 is locked at a low voltage level; when the node V9 is converted from a low voltage level to a high voltage level, the node V10 is locked at a low voltage level; therefore, the second output enable signal OE2 is affected only by the output enable signal OE. When the output enable signal OE is at a high voltage level, the second output enable signal OE2 is accordingly at a high voltage level. Therefore, the output enable control circuit 24 can ensure the logic control circuit 202 completes the logic reset.

Figure 7:
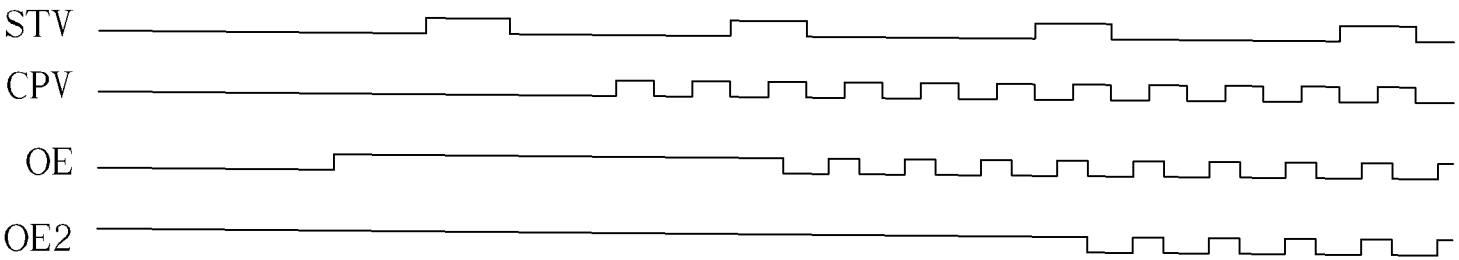
FIG. 7 is a waveform diagram illustrating the delay of the vertical clock signal.

Please refer to FIG. 7. FIG. 7 is a waveform diagram illustrating the delay of the vertical clock signal CPV. When the output of the vertical clock signal CPV is delayed, due to the effect of the output enable control circuit 24, the second output enable signal OE2 is able to maintain at a high voltage level after the output enable signal OE is inputted, for blocking the output of the scan signals X1~Xm. According to the output enable control circuit 24 described in FIG. 6, after the vertical synchronous signal STV and the vertical clock signal CPV are both triggered together for two times (i.e. the logic reset is completed), the second output enable signal OE2 is then outputted according to the output enable signal OE.

Figure 8:
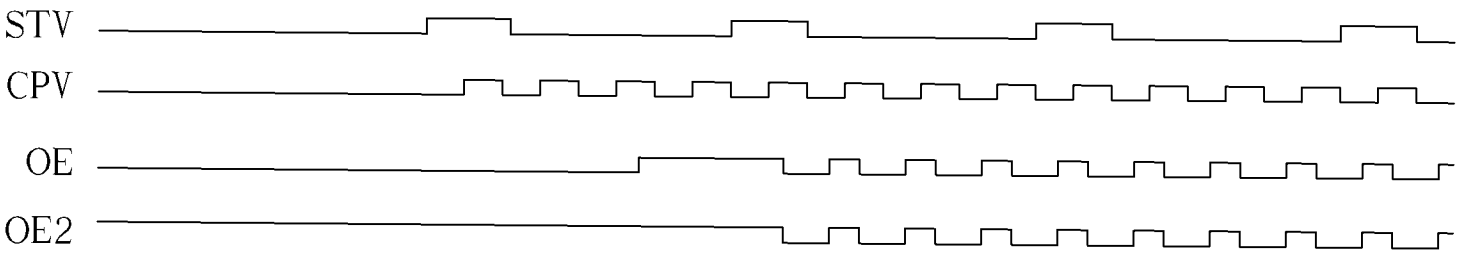
FIG. 8 is a waveform diagram illustrating the delay of the output enable signal.

Please refer to FIG. 8. FIG. 8 is a waveform diagram illustrating the delay of the output enable signal OE. When the output enable signal OE is delayed, due to the effect of the output enable control circuit 24, the second output enable signal OE2 is maintained at a high voltage level prior the vertical synchronous signal STV and the vertical clock signal CPV are both triggered together for two times. After the vertical synchronous signal STV and the vertical clock signal CPV have both been triggered together for two times the and logic reset is completed, the second output enable signal OE2 is then outputted according to the voltage level of the output enable signal OE.

Figure 9:
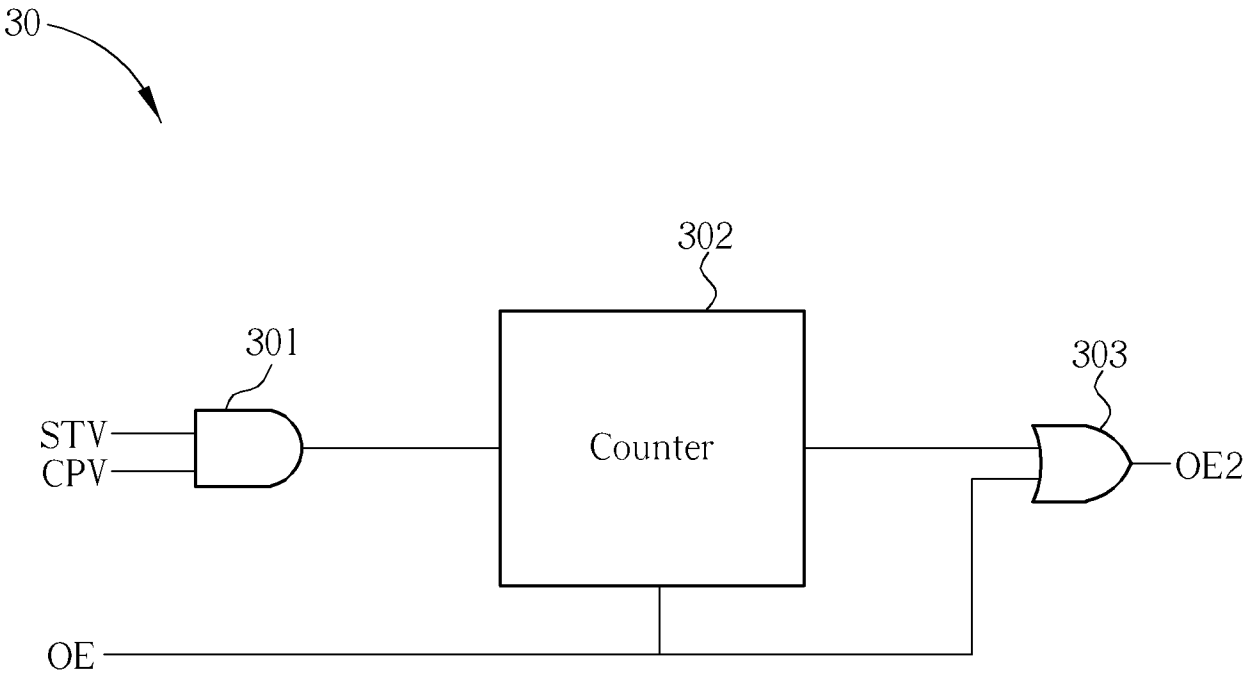
FIG. 9 is a diagram illustrating the output enable control circuit according to the second embodiment of the present invention.

Please refer to FIG. 9. FIG. 9 is a diagram illustrating the output enable control circuit according to the second embodiment of the present invention. The output enable control circuit 30 comprises an AND gate 301, a counter 302 and an OR gate 303. According to the first embodiment, the output enable control circuit 24 utilizes the first inverter 242, the first flip-flop 243, the second flip-flop 244, the second inverter 245, and first OR gate 246 and the third inverter 247 to monitor wither the vertical synchronous signal STV and the vertical clock signal CPV have been both triggered together for two times; in the second embodiment, the output enable control circuit 30 utilizes the counter 302 to monitor the vertical synchronous signal STV and the vertical clock signal CPV, i.e. when the vertical synchronous signal STV and the vertical clock signal CPV are both triggered together, the counter increments by 1. Initially, the output of the counter 302 is at a high voltage level, so the second output enable signal OE2 is accordingly at a high voltage level. When the vertical synchronous signal STV and the vertical clock signal CPV are both triggered together for two times (i.e. the counter 302 has been incremented by 2) and the output enable signal OE is at a high voltage level, the output of the counter 302 is at a low voltage level, and second output enable signal OE2 is outputted according to the voltage level of the output enable signal OE.

Figure 10:
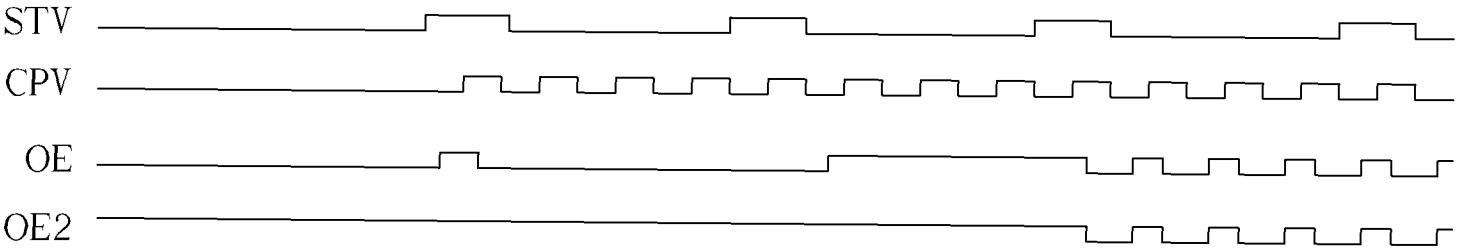
FIG. 10 is a waveform diagram illustrating when output enable signal OE occurs noise.

Please refer to FIG. 10. FIG. 10 is a waveform diagram illustrating when output enable signal OE occurs noise. When the vertical synchronous signal STV and the vertical clock signal CPV are both triggered together for two times and the output enable signal OE is at a high voltage level, the output of the counter 302 is converted from a high voltage level to a low voltage level. Therefore, the counter 302 not only ensures the gate driver 20 is reset correctly, but also prevents errors caused by the possible noise generated by the output enable signal OE. As illustrated in FIG. 10, the output enable signal OE occurs noise during the first pulse of the vertical synchronous signal STV, however, due to the effect of the output enable control circuit 30, the second output enable signal OE2 is still at a high voltage level. Furthermore, due to the output of the output enable signal OE is delayed, the second output enable signal OE2 is still maintained at a high voltage level after the vertical synchronous signal STV and the vertical clock signal CPV are both triggered together for two times. When the output enable signal OE is converted from a low voltage level to a high voltage level, the output of the counter 302 converts from a high voltage level to a low voltage level. Therefore, the second output enable signal OE2 is outputted according to the output of the output enable signal OE.

In conclusion, the gate driver of the present comprises a shift register, an output enable control circuit, a logic control circuit and an output driving circuit. The shift register generates a plurality of scan signals according to a vertical synchronous signal and a vertical clock signal. The output enable control circuit generates a second output enable signal according to the vertical synchronous signal, the vertical clock signal, and an output enable signal. After the vertical synchronous signal and the vertical clock signal are both triggered together for two times, the second output enable signal converts from a high voltage level to a low voltage level. The logic control circuit outputs the plurality of scan signals when the second output enable signal is at the low voltage level. The output driving circuit generates a plurality of gate signals by converting the voltage level of the plurality of scan signals, according to a gate high voltage level and a gate low voltage level. Therefore, when the output of the vertical clock signal and/or the output enable signal are delayed, the output enable control circuit ensures the logic control circuit is correctly reset, for preventing the generation of excessive current and the consequent damage caused to the gate driver.

Those skilled in the art will readily observe that numerous modifications and alterations of the device and method may be made while retaining the teachings of the invention.

What is claimed is:

1. A gate driver, comprising:

a shift register, for generating a plurality of scan signals according to a vertical synchronous signal and a vertical clock signal;

an output enable control circuit, for receiving the vertical synchronous signal, the vertical clock signal and an output enable signal and generating a second output enable signal according to the vertical synchronous signal, the vertical clock signal and the output enable signal, when the vertical synchronous signal and the vertical clock signal are both triggered two times, and each time the vertical clock signal is triggered overlaps with a time the vertical synchronous signal is triggered, the second output enable signal converting from a high voltage level to a low voltage level, the output enable control circuit comprising:

a first AND gate, comprising a first input end for receiving the vertical synchronous signal, a second input end for receiving the vertical clock signal, and an output end;

a first inverter, comprising an output end, and an input end electrically connected to the output end of the first AND gate;

a first flip-flop, comprising a clock input end electrically connected to the output end of the first AND gate, a data input end, a positive output end and a negative output end;

a second flip-flop, comprising a clock input end electrically connected to the output end of the first inverter, a data input end electrically connected to a ground end, a positive output end and a negative input end;

a second inverter, comprising an output end, and an input end electrically connected to the positive output end of the first flip-flop;

a first OR gate, comprising a first input end electrically connected to the negative output end of the first flip-flop, a second input end electrically connected to the positive output end of the second flip-flop, and an output end electrically connected to the data input end of the first flip-flop;

a third flip-flop, comprising a clock input end electrically connected to the output end of the second inverter, a data input end electrically connected to the ground end, a positive output end and a negative output end;

a fourth flip-flop, comprising a clock input end for receiving the output enable signal, a data input end electrically connected to the ground end, a positive output end and a negative output end;

a second OR gate, comprising a first input end electrically connected to the positive output end of the fourth flip-flop, a second input end for receiving the output enable signal, and an output end; and a third OR gate, comprising a first input end electrically connected to the positive output end of the third flip-flop, a second input end electrically connected to the output end of the second OR gate, and an output end for outputting the second output enable signal; and a logic control circuit, electrically connected to the shift register and the output enable control circuit, for outputting the plurality of the scan signals when the second output enable signal is at the low voltage level.

2. The gate driver of claim 1, wherein the vertical synchronous signal, the vertical clock signal and the output enable signal are provided by a timing controller.

3. The gate driver of claim 1, further comprising:

an output driving circuit, electrically connected to the logic control circuit, for converting voltage levels of the plurality of the scan signals to generate a plurality of gate signals, according to a gate high voltage level and a gate low voltage level.

4. The gate driver of claim 1, wherein the logic control circuit stops outputting the plurality of the scan signals when the second output enable signal is at the high voltage level.

5. The gate driver of claim 1, wherein when the vertical synchronous signal and the vertical clock signal are both triggered together for two times, the second output enable signal syncs with the output enable signal for converting from the high voltage level to the low voltage level.

6. The gate driver of claim 1, wherein when the vertical synchronous signal and the vertical clock signal are both triggered together, the vertical synchronous signal and the vertical clock signal are both at the high voltage level.

7. The gate driver of claim 1, wherein prior to the vertical synchronous signal and the vertical clock signal both being triggered together for two times, the second output enable signal is at the high voltage level.

* * * * *